US005569405A

United States Patent [19]

Nakazato et al.

[11] Patent Number: 5,569,405

[45] **Date of Patent: * Oct. 29, 1996**

[54] LOW PHOSPHOROUS ENGINE OIL COMPOSITIONS AND ADDITIVE COMPOSITIONS

[75] Inventors: Morikuni Nakazato; Takahiro Muramatsu; Shigeru Iwamoto, all of Ogasa-gun, Japan

[73] Assignee: Chevron Chemical Company, San Ramon, Calif.

[ * ] Notice: The portion of the term of this patent subsequent to Apr. 4, 2014, has been disclaimed.

[21] Appl. No.: 113,868

[22] Filed: Aug. 27, 1993

[30] Foreign Application Priority Data

Sep. 14, 1992 [JP] Japan ..... 4-272424

[51] Int. Cl.[6] ..... C10M 141/10

[52] U.S. Cl. ..... 508/192; 508/373; 508/376

[58] Field of Search ..... 252/32.7 E, 47, 252/48.2, 33.6, 49.5, 48.6, 33.3

[56] References Cited

U.S. PATENT DOCUMENTS

| | | | |
|---|---|---|---|
| 3,236,770 | 2/1966 | Matson et al. | 252/32.7 |
| 3,240,705 | 3/1966 | Orloff | 252/48.4 |
| 3,876,550 | 4/1975 | Holubec | 252/47.5 |
| 3,923,669 | 12/1975 | Newingham et al. | 252/32.7 E |
| 4,125,479 | 11/1978 | Chesluk et al. | 252/33.6 |
| 4,178,258 | 12/1979 | Papay et al. | 252/32.7 E |
| 4,248,720 | 2/1981 | Coupland et al. | 252/32.7 E |
| 4,302,683 | 11/1981 | Burton | 290/4 R |
| 4,383,931 | 5/1983 | Ryu et al. | 252/32.7 E |
| 4,394,276 | 7/1983 | Small, Jr. | 252/48.4 |
| 4,501,678 | 2/1985 | Katayama et al. | 252/32.7 E |
| 4,609,480 | 9/1986 | Hata et al. | 252/32.7 E |
| 4,648,985 | 3/1987 | Thorsell et al. | 252/47.5 |
| 4,746,448 | 5/1988 | Kenmochi et al. | 252/34 |
| 4,764,294 | 8/1988 | Habeeb et al. | 252/32.7 E |
| 4,857,572 | 8/1989 | Meier et al. | 252/48.2 |
| 4,859,352 | 8/1989 | Waynick | 252/41 |
| 4,879,054 | 11/1989 | Waynick | 252/41 |
| 4,880,551 | 11/1989 | Doe | 252/47.5 |
| 5,091,099 | 2/1992 | Evans | 252/48.6 |

FOREIGN PATENT DOCUMENTS

| | | |
|---|---|---|
| 0281992 | 9/1988 | European Pat. Off. . |
| 0480734 | 4/1992 | European Pat. Off. . |
| 1569433 | 5/1980 | United Kingdom . |

*Primary Examiner*—Margaret Medley
*Attorney, Agent, or Firm*—E. A. Schaal

[57] ABSTRACT

An engine oil composition having a base oil, an ashless dispersant, a metal-containing detergent, zinc dithiophosphate and a sulfur-containing phenol derivative. Examples of sulfur-containing phenol derivative include 2,4-bis{(octylthio)methyl}-o-cresol, 2,2-thiodiethylenebis{3-(3,5-di-t-butyl-4-hydroxyphenyl)propionate}, and tridecyl 2-(3,5-di-ti-butyl-4-hydroxybenzylthio)acetate.

7 Claims, No Drawings

LOW PHOSPHOROUS ENGINE OIL COMPOSITIONS AND ADDITIVE COMPOSITIONS

This invention relates to improved lubricating oils having excellent characteristics in anti-wear, detergency, oxidation stability and viscosity-temperature correlation. Especially, this invention relates to an engine oil that is hardly deteriorated on contact with nitrogen oxide gas (NOx) and that can work stably for a long time.

BACKGROUND OF THE INVENTION

Automobile spark ignition and diesel engines have valve train systems, including valves, cams and rocker arms, which present special lubrication concerns. It is extremely important that the engine oil protects these parts from wear. Further, it is important for engine oils to suppress the production of deposits in the engines. Such deposits are produced from non-combustibles and incomplete combustibles of hydrocarbon fuels (e.g., gasoline, diesel fuel oil) and by the deterioration of the engine oil employed.

Engine oils use a mineral oil or a synthetic oil as a base oil. However, simple base oils alone do not provide the necessary properties to provide the necessary wear protection, deposit control, etc., required to protect internal combustion engines. Thus, base oils are formulated with various additives, for imparting auxiliary functions, such as ashless dispersants, metallic detergents (i.e., metal-containing detergents), antiwear agents, antioxidants (i.e., oxidation inhibitors), viscosity index improvers and the like to give a compounded oil (i.e., a lubricating oil composition).

Meanwhile, combustion gas produced in a gasoline engine or a diesel engine is mostly exhausted from the exhaust pipe as exhaust gas, but a portion of the combustion gas leaks through a gap between piston and cylinder to blow into the crankcase as blow-by gas. Since the blow-by gas contains nitrogen oxide gas ($NO_x$) of high concentration, it oxidizes and deteriorates an engine oil (crank case oil) charged in the crank case. Recently, since lightweight motor cam are required in view of saving energy (improving fuel-efficiency), the crank cases of the engines are apt to be made small. Therefore, the amount of the engine oil charged in such a small crank case is lowered and the relative amount of nitrogen oxide introduced into the crank case as blow-by gas per the amount of the charged engine oil is increased. Consequently, the deterioration of engine oil is apt to be promoted. In addition to the above-described reason, since recent engines are often used to satisfy severe demands (high speed and/or high power), the concentration of nitrogen oxide in blow-by gas is further increasing.

As is described above, factors in the deterioration of engine oils are more and more increasing. Once an engine oil is deteriorated, its acid value is increased and sludge is deposited in the crank case. Therefore, engine oils are desired to be protected from the deterioration as far as possible. Hitherto, in order to inhibit the oxidation and the deposition of sludge, additives such as oxidation inhibitors (e.g., zinc dithiophosphate, oxidation inhibitors of phenol type) and detergent-dispersants (e.g., ashless dispersants, metal-containing detergents) have been added to engine oils. However, since recent engines are apt to be used under severe conditions as is described above, the known additives cannot satisfactorily prevent engine oils from deteriorating. Therefore, it is desired to take measures to meet this problem.

The use of phenol sulfides in lubricating oils is well known in the art.

U.S. Pat. No. 3,236,770 discloses a lubricating oil having a dialkylthiocarbonate, and either a metal dialkyl dithiophosphate; a basic alkaline earth metal sulfonate; or a basic alkaline earth metal alkyl phenol sulfide.

U.S. Pat. No. 3,240,705 discloses a 2,2'-trithiobis-(4-halo-6-alkylphenol).

U.S. Pat. No. 4,302,683 discloses an organo-molybdenum complex prepared by reacting a hydrocarbyl substituted thio-bis-phenol with a molybdenum source.

U.S. Pat. No. 4,764,294 discloses an engine oil having a base oil, a metal phosphate, a metal carbamate, and a para alkyl hydroxy-aryl sulfide.

The use of dithiocarbamates in lubricating oils is well known in the art.

U.S. Pat. No. 3,876,550 discloses lubricating compositions containing an alkylene bis(dithiocarbamate), as an antioxidant, and a substituted succinic acid as a rust inhibitor. The alkylene dithiocarbamate is represented in the patent by the formula $R^1R^2N$—C(S)—S-alkylene-S—C(S)—$NR^3R^4$. Example 5 of the patent describes a crankcase lubricant containing a viscosity improver, an ashless dispersant and methylene bis(dibutyldithiocarbamate). The patent further teaches that the composition may also contain various other additives, for example, detergents, dispersants, viscosity improvers, extreme pressure agents, antiwear additives, etc., as well as other oxidation inhibitors and corrosion inhibitors and cites an extensive list of extreme pressure agents, corrosion inhibitors and antioxidants, including zinc salts of phosphorodithoic acid.

The use of methylene bis(dibutyldithiocarbamate) as an oxidation inhibitor in lubricating oils, in combination with other ingredients, is also disclosed in U.S. Pat. Nos. 4,125,479 and 4,880,551.

U.S. Pat. No. 4,879,054 is directed to cold temperature greases and teaches using dithiocarbamates such as Vanlube 7723, i.e., 4,4'-methylene bis(dithiocarbamate), in such greases to provide extreme pressure antiwear properties. Examples 13–18 describe using Vanlube 7723 and triarylphosphate as replacements for lead naphthenate and zinc dithiophosphate.

The use of dithiocarbamates as extreme pressure antiwear additives is also taught by U.S. Pat. Nos. 4,859,352, and 4,648,985 teaches that the combination of dithiocarbamates with zinc dithiophosphate and copper salts of carboxylic acid provide lubricants with extreme pressure properties.

U.S. Pat. No. 4,383,931 discloses using lubricating oils containing an oil-soluble molybdenyl bis-β-diketonate in combination with zinc dithiophosphate. Methylene bis(dihydrocarbyldithiocarbamates) are used as ashless antioxidants and extreme pressure agents.

U.S. Pat. No. 4,501,678 discloses using lubricating oils containing an alkyl thiocarbamoyl compound and either a molybdenum thiocarbamoyl compound or a molybdenum organophosphorodithioate.

U.S. Pat. No. 4,609,480 discloses using lubricating oils containing an alkyl thiocarbamoyl compound and a 1,3,4-thiadiazole compound. The oils can also contain, among other things, sulfurized oxymolydenum organophosphorodithioates.

SUMMARY OF THE INVENTION

The present invention provides a low-phosphorous lubricating oil composition that is hardly deteriorated on contact with nitrogen oxide gas ($NO_x$) and which can work stably for a long time. That composition has a major amount of a base oil of lubricating viscosity, from 0.5 to 20 wt. % of metal-containing detergent, from 0.1 to 3 wt. % of zinc dithiophosphate, from 0.5 to 15 wt. % of ashless dispersant, and from 0.05 to 5 wt. % of a sulfur-containing phenol derivative.

The sulfur-containing phenol derivative is selected from the group consisting of:

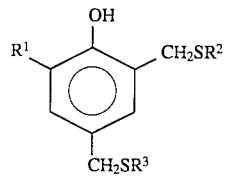
(I)

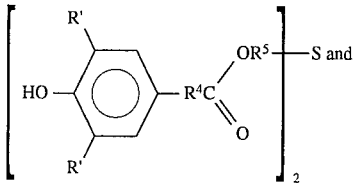
(II)

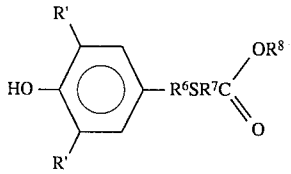
(III)

wherein $R^1$, $R^2$, $R^3$, and $R^8$ are the same or different and each represents an alkyl group of 1 to 18 carbon atoms; $R^4$, $R^5$, $R^6$, and $R^7$ are the same or different and each represents an alkylene group of 1 to 3 carbon atoms; and R' represents an alkyl group of 1 to 4 carbon atoms.

Preferably, the sulfur-containing phenol derivative comprises 0.1 to 3 wt. % of the composition. The alkyl groups of the sulfur-containing phenol derivative should have 1–14 carbon atoms. Examples of preferred sulfur-containing phenol derivatives are 2,4-bis{(octylthio)methyl}-o-cresol, 2,2-thio-diethylenebis{ 3-(3,5-di-t-butyl-4-hydroxyphenyl)propionate},or tridecyl2-(3,5-di-t-butyl-4-hydroxybenzylthio)acetate.

Preferably, the low-phosphorous lubricating oil composition also has from 0.05 to 8 wt. % of an alkylthiocarbamoyl compound represented by the formula:

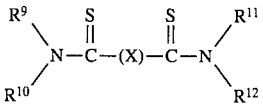

wherein $R^9$, $R^{10}$, $R^{11}$ and $R^{12}$ are the same or different and each represents an alkyl group of 1–18 carbon atoms, and (X) represents S, S—S, S—$CH_2$—S, S—$CH_2$—$CH_2$—S, S—$CH_2$—$CH_2$—$CH_2$—S or S—$CH_2$—$CH(CH_3)$—S. Preferably, $R^9$, $R^{10}$, $R^{11}$ and $R^{12}$ are independently selected from alkyl groups having 1 to 6 carbon atoms. More preferably, the dithiocarbamate compound is methylene bis(dibutyldithiocarbamate).

Preferably, the zinc dithiophosphate is a secondary alkyl type.

This invention can further involve an additive concentrate having100 weight parts of a metal-containing detergent, from 10 to 700 weight parts of an ashless dispersant, and from 2 to 200 weight parts of the sulfur-containing phenol derivative described above.

It is an object of the present invention to provide an engine oil composition that is hardly deteriorated on contact with nitrogen oxide gas ($NO_x$), and particularly to provide an engine oil composition that can work stably even if exposed to nitrogen oxide gas of high concentration for a long time.

DETAILED DESCRIPTION OF THE INVENTION

In its broadest aspect, the present invention is an engine oil composition comprising a base oil, an ashless dispersant, a metal-containing detergent, zinc dithiophosphate and a sulfur-containing phenol derivative.

Representative examples of the sulfur-containing phenol derivative employed for the invention are the compounds represented by the following formulae (1), (2) and (3):

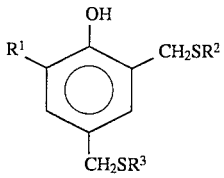
(I)

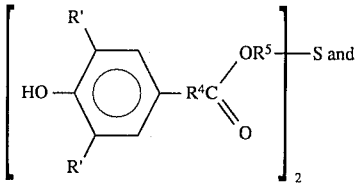
(II)

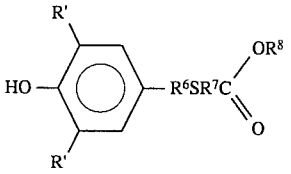
(III)

wherein $R^1$, $R^2$, $R^3$ and $R^8$ are the same or different and each represents an alkyl group of 1–18 carbon atoms; $R^4$, $R^5$, $R^6$ and $R^7$ are the same or different and each represents an alkylene group of 1–3 carbon atoms; and R' represents an alkyl group of 1 to 4 carbon atoms.

The sulfur-containing phenol derivative of the formulae (I), (11) or (111) is dissolved or dispersed in a base oil together with various additives, such as metal-containing detergents, ashless dispersants, zinc dithiophosphate, viscosity index improvers and the like, in the same manner as known engine oil compositions (i.e., engine oils).

A variety of metal-containing detergents, ashless dispersants, zinc dithiophosphates, viscosity index improvers and base oils are known. These known materials or their analogous compounds can be employed for the preparation of the engine oil of the invention. Representative examples of these materials are described below.

BASE OIL

The base oil may be a mineral oil or synthetic oil or a blend of mineral oils and/or synthetic oils blended to give a base oil of the desired internal combustion engine oil viscosity. Typically, individually the oils used as its base oil will have a viscosity range of about from 10 to 120 cST at 40° C. and will be selected or blended depending on the desired end use and the additives in the finished oil to give the desired grade of engine oil.

METAL-CONTAINING DETERGENT

The metal-containing detergent may be a metal phenate or a metal sulfonate. The metal phenate is an alkaline earth metal salt of sulfide of alkylphenol having an alkyl group of about 8–30 carbon atoms. Generally employed alkaline earth metals are calcium, magnesium and barium. The metal sulfonate is an alkaline each metal salt of a sulfonated aromatic compound or a sulfonated mineral oil derived from lubricating oil having a molecular weight of about 400–600. Generally employed alkaline earth metals are also calcium, magnesium and barium. The metal phenate and metal sulfonate can be used singly or in combination. Also employed are other metal-containing detergents such as salicylate, phosphonate and naphthenate of alkaline earth metals. These detergents can be employed single or in combination. The aforementioned phenate and sulfonate can be employed in combination with these other metal-containing detergents. The metal-containing detergents may be of a neutral type or of an over-based type having an alkalinity value of 150–300 or more.

The metal-containing detergent is generally incorporated into an engine oil in an amount of 0.5–20 wt. % per total amount of the engine oil.

ASHLESS DISPERSANT

Examples of the ashless dispersant used for the invention include succinimides, succinic esters, and benzylamine, each of which has an alkyl or alkenyl group of a molecular weight of about 700–3,000. In addition to these compounds, their derivatives (e.g., borated derivatives) are also employable. The ashless dispersant is generally incorporated into an engine oil in an amount of 0.5–15 wt. % per total amount of the engine oil.

ZINC DITHIOPHOSPHATE

The zinc dithiophosphate, used as an anti-wear agent or an oxidation inhibitor, generally is zinc dihydrocarbyl-dithiophosphate having an alkyl group of 3–18 carbon atoms or an alkylaryl group having an alkyl group of 3–18 carbon atoms. This agent is generally incorporated into an engine oil in an amount of 0.1–3 wt. % per total amount of the engine oil.

VISCOSITY INDEX IMPROVER

Examples of the viscosity index improvers are poly-(alkyl methacrylate), ethylene-propylene copolymer, styrene-butadiene copolymer, and polyisoprene. Viscosity index improvers of dispersant type (having increased dispersancy) or multi-function type are also employed. These viscosity index improvers can be used singly or in combination. The amount of viscosity index improver to be incorporated into an engine oil varies with desired viscosity of the compounded engine oil, and generally in the range of 0.5–20 wt. % per total amount of the engine oil.

The engine oil of the invention may contain various additional additives other than those described above, if desired. Examples of such additional additives include known extreme pressure agents, corrosion inhibitors, rust inhibitors, friction modifiers, anti-foaming agents and pour point depressants. In addition to these additives, other oxidation inhibitors (e.g., hindered phenol), anti-wear agents and multi-functional additives (e.g., organic molybdenum compounds such as molybdenum dithiophosphate) may be employed in combination.

SULFUR-CONTAINING PHENOL DERIVATIVE

Details of the sulfur-containing phenol derivative characterizing the present invention are described below.

As is described above, the sulfur-containing phenol derivative preferably used for the invention is a compound represented by one of the following formulae (I), (II), and (III):

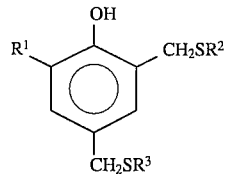

(I)

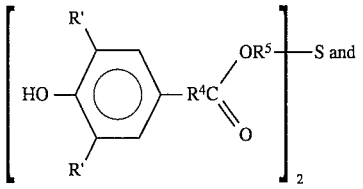

(II)

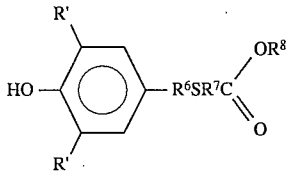

(III)

wherein $R^1$, $R^2$, $R^3$ and $R^8$ am the same or different and each represents an alkyl group of 1–18 carbon atoms; $R^4$, $R^5$, $R^6$, and $R^7$ are the same or different and each represents an alkylene group of 1–3 carbon atoms; and R' represents an alkyl group of 1 to 4 carbon atoms.

Although the above sulfur-containing phenol derivatives are per se known as oxidation inhibitors for plastics, the present inventors have discovered that they effectively prevent engine oils from deteriorating.

The alkyl groups in the above formulae may be of straight chain type or branched chain type. Examples of them include methyl, ethyl, propyl, n-butyl, isobutyl, pentyl, isopentyl group, heptyl group, octyl group, 2-ethylhexyl, nonyl, decyl, dodecyl and tridecyl. Particularly preferred are alkyl groups having 1–14 carbon atoms. Examples of the alkylene group in the formulae are methylene, ethylene and propylene.

Each of the sulfur-containing phenol derivatives of the formulae (I), (II), and (III) can be used singly or in combination with other sulfur-containing phenol derivatives. Preferably, the sulfur-containing phenol derivative of the formula (I) is used in combination with the sulfur-containing phenols derivative of formulae (II) or (III).

The sulfur-containing phenol derivative is generally incorporated into an engine oil in an amount of 0.05 to 5 wt. %, preferably 0.1 to 3 wt. %, per total amount of the engine oil.

As is described above, the sulfur-containing phenol derivative is used in combination with a dithiophosphate such as zinc dialkyldithiophosphate or zinc dihydrocarbyldithiophosphate, which are known oxidation inhibitors for engine oils. The preferred weight ratio is in the range of 1:0.1–1:20, particularly 1:0.2–1:10 (=sulfur-containing phenol derivative:dithiophosphate).

DITHIOCARBAMATE COMPOUND

Preferably, the engine oil composition of the invention further contains an alkylthiocarbamoyl compound represented by the following formula:

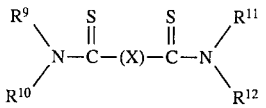

wherein $R^9$, $R^{10}$, $R^{11}$ and $R^{12}$ are the same or different and each represents an alkyl group of 1–18 carbon atoms, and (X) represents S, S—S, S—$CH_2$—S, S—$CH_2$—$CH_2$—S, S—$CH_2$—$CH_2$—$CH_2$—S or S—$CH_2$—CH($CH_3$)—S.

The alkylthiocarbamoyl compounds of the above formula are known compounds, which am employed as a vulcanization accelerator or an additive of gear oils and turbine oils. The alkyl group in this formula may be of straight chain type or branched chain type. Examples of the alkyl group are methyl, ethyl, propyl, n-butyl, isobutyl, pentyl, isopentyl, heptyl, octyl, 2-ethylhexyl, nonyl, decyl, and dodecyl. Preferred are alkyl groups having 1–10 carbon atoms. Concrete examples of the alkylthiocarbamoyl compounds include methylene bis(dibutyl dithiocarbamate), bis(dimethylthiocarbamoyl)-monosulfide, bis(dimethylthiocarbamoyl)disulfide, bis(diamylthiocarbamoyl)disulfide, and bis(dioctylthiocarbamoyl)disulfide. Further, metal dithiocarbamates such as zinc dithiocarbamate, copper dithiocarbamate and molybdenum dithiocarbamate are also employable. These compounds can be used singly or in combination of two or more compounds.

The alkylthiocarbamoyl compound is generally incorporated into an engine oil in an amount of 0.05–8 wt. %., preferably 0.1–4 wt. %, per total amount of the engine oil.

When the alkylthiocarbamoyl compound is incorporated into the engine oil of the invention, the preferred weight ratio of the compound to the sulfur-containing phenol derivative is in the range of 1:0.1 to 1:20, particularly 1:0.2 to 1:10 (=sulfur-containing phenol derivative:alkylthiocarbamoyl compound).

EXAMPLES

The invention will be further illustrated by the following examples that set forth particularly advantageous method embodiments. While the Examples are provided to illustrate the present invention, they are not intended to limit it.

Various engine oils set forth in Table 1 were prepared from the same components such as paraffinic mineral oil (viscosity index value: 100), viscosity index improver and additives package (i.e., a mineral oil in which the same ashless dispersant, metal-containing detergent and zinc dialkyldithiophosphate are dissolved), and various additives set forth in Table 1. The viscosity of each prepared engine oil was adjusted to SAE 10W30.

40 ml of each prepared engine oil and 2 ml of regular gasoline were mixed, and then iron-copper catalyst (⅙ scale of the sample regulated in the oxidation test of JIS-K-2514) was added to the mixture. The obtained mixture was heated to 140° C. At this temperature, nitrogen gas containing 0.8% nitrogen monoxide (NO) and wet air were continuously introduced into the mixture at the rate of 5.7 l/hour and 15 l/hour, respectively. While the gases were blowing into the engine oil, the amount of deterioration of the oil was observed in the following manner.

The engine oil was periodically sampled and charged in an optical cell of 0. 1 mm thickness to measure IR absorption spectrum. The amount of nitrate 15 ester formed in the sampled oil was evaluated by the absorbance at 1630 $cm^{-1}$. The lifetime of the sampled engine oil was determined by the time when the absorbance was reached to 0.2.

TABLE I

| Engine oil samples Sample No. | 1 | 2 | 3 | 4 | 5 | 6 | 7 | 8 |
|---|---|---|---|---|---|---|---|---|
| Viscosity index improver of dispersant type | 5.7 | 5.7 | 5.7 | 5.7 | 5.7 | 5.7 | 5.7 | 5.7 |
| Additives package | 6.5 | 6.5 | 6.5 | 6.5 | 6.5 | 6.5 | 6.5 | 6.5 |
| Oxidation inhibitor of amine type | — | 0.6 | — | — | — | — | — | — |
| Oxidation inhibitor of phenol type | — | — | 0.4 | — | — | — | — | — |
| Sulfur containing phenol derivative (I) | — | — | — | 0.3 | 0.15 | 0.15 | 0.15 | — |
| Sulfur containing phenol derivative (II) | — | — | — | — | 0.15 | — | — | 0.15 |
| Sulfur containing phenol derivative (III) | — | — | — | — | — | 0.15 | — | — |
| Dithiocarbamate compound | — | — | — | — | — | — | 0.15 | 0.15 |
| Paraffinic mineral oil | 87.8 | 87.2 | 87.4 | 87.5 | 87.5 | 87.5 | 87.5 | 87.5 |
| Lifetime (hour) | 50 | 79 | 86 | 115 | 120 | 116 | 122 | 126 |

As is described above, paraffinic mineral oil (viscosity index value: 100) was used for the engine oils set forth in Table 1 as a base oil, and each of the engine oils was prepared to satisfy the viscosity condition regulated in SAE 10W30 of API service. Further, other supplemental additives such as antifoaming agents were added when they were required. Details of the additives set forth in Table 1 am as follows:

Additives package: Mixture of boric acid-modified succinic imide (ashless dispersant), calcium sulfonate (metal-containing detergent) and zinc dithiophosphate (of secondary alkyl type). The weight ratio of these components is 100: 40:40 in the order described. This package, at 6.5% wt %, resulted in the phosphorus level of 0.08 wt % of engine oil samples.

Oxidation inhibitor of amine type: Dialkyldiphenylamine

Oxidation inhibitor of phenol type: 2,6-di-t-butyl-p-cresol

Sulfur-containing phenol derivative (I): 2,4-bis{(octylthio)methyl}-o-cresol

Sulfur-containing phenol derivative (II): 2,2-thio-diethylenebis{3-(3.5-di-t-butyl-4-hydroxyphenyl)propionate}

Sulfur-containing phenol derivative (III); Tridecyl 2-(3,5-di-t-butyl-4 -hydroxybenzylthio)acetate Dithiocarbamate compound: Methylenebis(dibutyldithiocarbamate)

As is clear from the test data set forth in Table 1, each of the engine oils of the present invention (i.e., the engine oils of No. 4–No. 8), in which the sulfur-containing phenol derivative had been added, exhibited little deterioration and a long lifetime, even if exposed to nitrogen oxide of high concentration. Particularly, the engine oils of No. 7 and No. 8, in which the sulfur-containing phenol derivative had been incorporated with an alkylthiocarbamoyl compound, exhibited longer lifetimes than others.

The engine oil composition of the present invention, which is prepared by incorporating a sulfur-containing phenol derivative to a composition of a lubricating base oil, an ashless dispersant, a metal-containing detergent and zinc dithiophosphate, is hardly deteriorated on contact with nitrogen oxide ($NO_x$) gas of high concentration and can work stably for a long time.

While the present invention has been described with reference to specific embodiments, this application is intended to cover those various changes and substitutions that may be made by those skilled in the art without departing from the spirit and scope of the appended claims.

What is claimed is:

1. A low-phosphorous lubricating oil composition for internal combustion engines comprising:

(a) a major amount of a base oil of lubricating viscosity, (b) from 0.5 to 20 wt. % of metal-containing detergent selected from the group consisting of a metal phenate and a metal sulfonate, (c) from 0.5 to 15 wt. % of ashless dispersant selected from the group consisting of borated succinimides and succinic esters, (d) from 0.1 to 3 wt. % of a secondary alkyl zinc dithiophosphate, (e) from 0.05 to 5 wt. % of a sulfur-containing phenol derivative selected from the group consisting of:

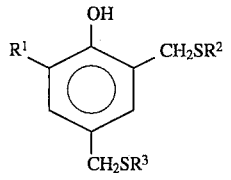

(i)

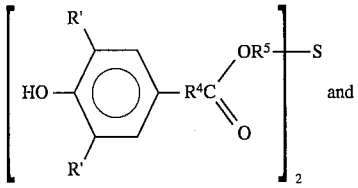

(ii)

-continued

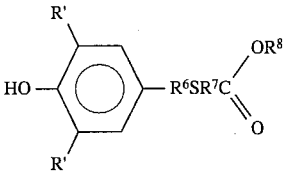

(iii)

wherein $R^1$, $R^2$, $R^3$, and $R^8$ are the same or different and each represents an alkyl group of 1 to 18 carbon atoms; $R^4$, $R^5$, $R^6$, and $R^7$ are the same or different and each represents an alkylene group of 1 to 3 carbon atoms; and R' represents an alkyl group of 1 to 4 carbon atoms; and (f) from 0.05 to 8 wt. % of an alkylthiocarbamoyl compound represented by the formula:

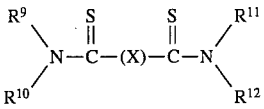

wherein $R^9$, $R^{10}$, $R^{11}$ and $R^{12}$ are the same or different and each represents an alkyl group of 1–18 carbon atoms, and (X) represents S, S—S, S—$CH_2$—S, S—$CH_2$—$CH_2$—S, S—$CH_2$—$CH_2$—$CH_2$—S or S—$CH_2$—$CH(CH_3)$—S.

2. A low-phosphorous lubricating oil composition according to claim 1 wherein the sulfur-containing phenol derivative comprises 0.1 to 3 wt. % of the composition.

3. A low-phosphorous lubricating oil composition according to claim 1 wherein $R^1$, $R^2$, $R^3$, and $R^8$ alkyl groups of the sulfur-containing phenol derivative have 1–14 carbon atoms.

4. A low-phosphorous lubricating oil composition according to claim 1 wherein the sulfur-containing phenol derivative is selected from the group consisting of 2,4-bis{(octylthio)methyl}-o-cresol, 2,2-thio-diethylenebis{3-(3,5-di-t-butyl-4-hydroxyphenyl)propionate}, and tridecyl 2-(3,5-di-t-butyl-4-hydroxybenzylthio)acetate.

5. A low-phosphorous lubricating oil composition according to claim 1 wherein the zinc dithiophosphate has an alkyl group of 3–18 carbon atoms or an alkylaryl group having an alkyl group of 3–18 carbon atoms.

6. A low-phosphorous lubricating oil composition according to claim 1 wherein $R^9$, $R^{10}$, $R^{11}$ and $R^{12}$ are independently selected from alkyl groups having 1 to 6 carbon atoms.

7. The low phophorous oil composition of claim 6 wherein the dithiocarbamate compound is methylene bis-(dibutyldithiocarbamate).

* * * * *